US005289242A

United States Patent [19]

Christensen et al.

[11] Patent Number: 5,289,242

[45] Date of Patent: Feb. 22, 1994

[54] METHOD AND SYSTEM FOR IDENTIFYING THE TYPE OF TONER PRINT CARTRIDGES LOADED INTO ELECTROPHOTOGRAPHIC PRINTERS

[75] Inventors: K. Trent Christensen, Boise, Id.; Antonio P. Flores, Deming, N. Mex.; Mark D. Montierth, Boise, Id.

[73] Assignee: Hewlett-Packard, Palo Alto, Calif.

[21] Appl. No.: 977,326

[22] Filed: Nov. 17, 1992

[51] Int. Cl.[5] ..... G03G 15/06; G03G 21/00

[52] U.S. Cl. ..... 355/260; 355/203

[58] Field of Search ..... 355/260, 203-206, 355/245; 400/207 E; 200/243, 61.41, 61.42, 61.43; 346/140 R

[56] References Cited

U.S. PATENT DOCUMENTS

| | | | |
|---|---|---|---|
| 4,803,521 | 2/1989 | Honda . | |
| 4,907,018 | 3/1990 | Pinkerpell et al. | 346/140 R X |
| 4,912,512 | 3/1990 | Midorikawa et al. | 355/260 |
| 4,963,939 | 10/1990 | Kurando et al. | 355/260 |
| 5,184,181 | 2/1993 | Kurando et al. | 355/260 |

FOREIGN PATENT DOCUMENTS

| | | | |
|---|---|---|---|
| 61-41159 | 2/1986 | Japan | 355/260 |
| 62-39270 | 2/1987 | Japan | 400/207 E |
| 62-173482 | 7/1987 | Japan | 355/260 |
| 63-82492 | 4/1988 | Japan | 355/260 |
| 63-82493 | 4/1988 | Japan | 355/260 |
| 4-062564 | 2/1992 | Japan | 355/260 |

OTHER PUBLICATIONS

Craft, J. A., IBM Tech. Disc. Bulletin, Sep. 1982, "Low Cost Cartridge Code Detector", vol. 25, No. 4, pp. 1980-1981.

Fowler, N., Xerox Disc. Journal, "Replaceable Cartridge With Detectable Hologram", vol. 17., No. 4, Jul./Aug. 1992, p. 221.

*Primary Examiner*—A. T. Grimley
*Assistant Examiner*—Shuk Y. Lee

[57] ABSTRACT

A method and system for indicating the type of toner print cartridge which has been loaded into an electrophotographic printer. These include the mounting of a toner-type-indicative conductive strip on the outside surface of a toner print cartridge and then mating this conductive strip with a pair of electrical contacts within the printer housing when a lid or cover carrying the toner print cartridge is closed into the printer housing. Go or no go closed loop control and switching circuitry is connected between the pair of electrical contacts and a formatter within the printer to thereby instruct the printer either to print, or not to print, respectively, depending upon the presence or absence of the conductive strip on the outside surface of the toner print cartridge. In a preferred embodiment of the invention, an extended board connect stage is provided with an electronic (digital) two-position switch which is selectively addressable by a custom personality cartridge. This operation switches the voltage level on a toner cartridge sense line into and out of electrical connection with a formatter of the printer to thereby indicate to the user the type of print cartridge which has been loaded into the printer.

11 Claims, 3 Drawing Sheets

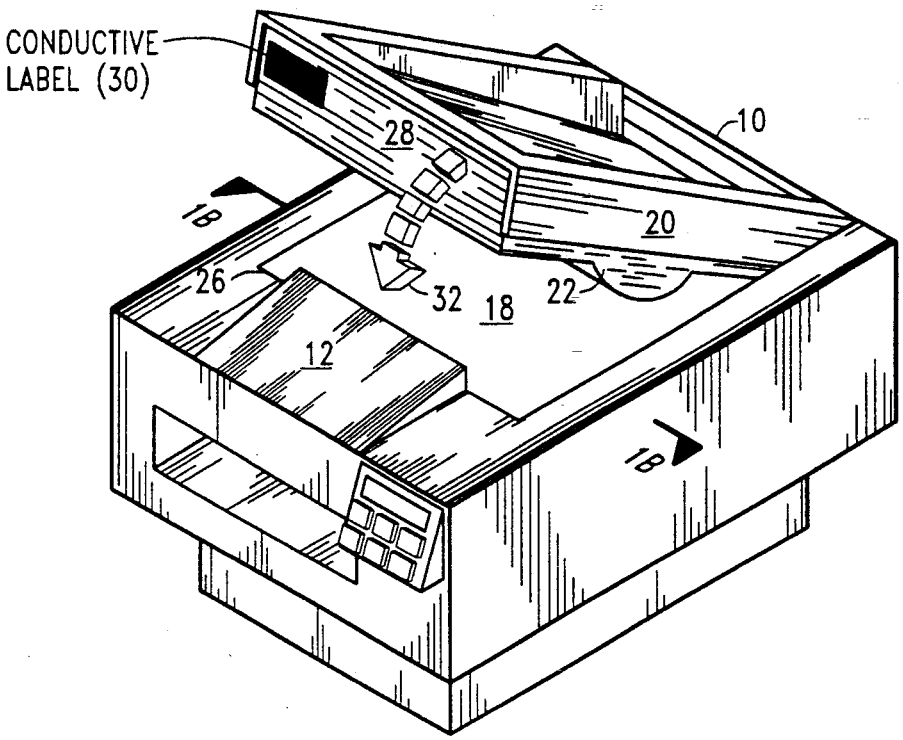
FIG. 1A.
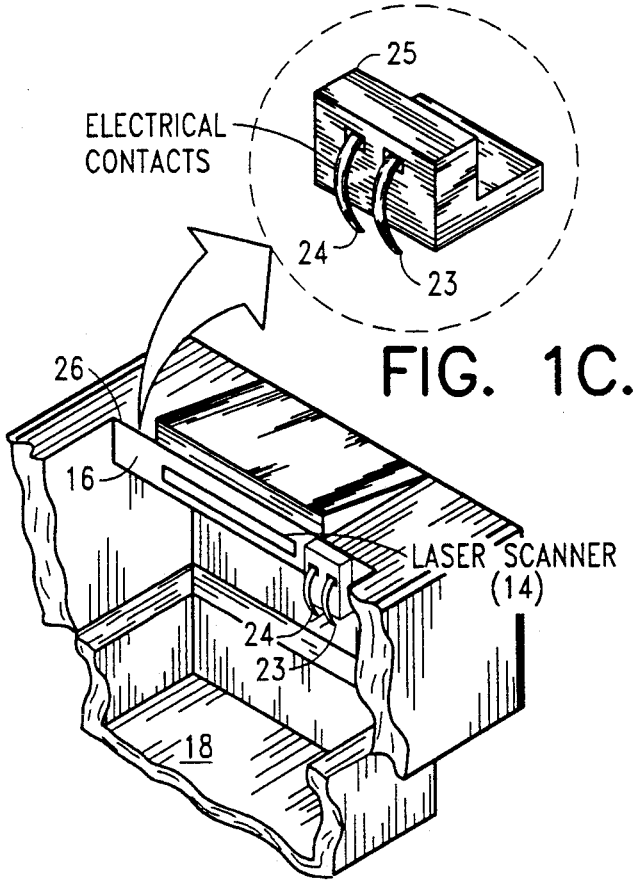
FIG. 1C.
FIG. 1B.

METHOD AND SYSTEM FOR IDENTIFYING THE TYPE OF TONER PRINT CARTRIDGES LOADED INTO ELECTROPHOTOGRAPHIC PRINTERS

TECHNICAL FIELD

This invention relates generally to the identification of print cartridges used in electrophotographic printers, also known in the art as laser printers. More particularly, the present invention is directed to a direct current (DC) controllable method and system for easily and rapidly identifying to both the user and the printer the type of print cartridge which has been loaded into the printer. Additionally, this control system is easily retrofittable into existing printers.

BACKGROUND ART

Typically, electrophotographic page printers use a dry toner powder to develop a desired image on a photoconductive drum within the printer. This dry toner powder is contained in an assembly known as a toner print cartridge. The toner print cartridge is designed to operate in a given printer having sensors or mechanical switches therein which allow the internal software of the printer to determine if the toner cartridge has been properly installed before printing. This toner cartridge sensing scheme has been normally dedicated to only sensing the presence of the toner cartridge, but not the type of toner within the cartridge. A molded plastic tab has been typically employed on the toner cartridge as a means for depressing a cartridge sensing switch within the printer which thereby operates to indicate to the user and the printer the presence of a toner cartridge loaded therein. The print engine of the printer, the control software thereof, and the toner cartridge combination are difficult to modify in order to allow sensing of other desired features such as the use of a magnetic ink character recognition (MICR) toner, color toner, or other types of toner.

Another kind of cartridge-type identification system which is somewhat similar to the above plastic tab approach utilizes a projection member or unit in combination with a plurality of microswitches, all of which are located within the printer housing. The projection unit must be specifically located and positioned directly adjacent to a specifically selected microswitch so that the closure of this microswitch by the projection unit would indicate the particular type of print cartridge that has been loaded into the printer. This type of print cartridge identification system is described in U.S. Pat. No. 4,500,195 issued to Houoso and assigned to Canon of Japan, and is incorporated herein by reference.

There is yet another cartridge identification system which has been designed to detect the type of toner cartridge in addition to detecting the presence or absence of such cartridge in an electrophotographic printer. This system is described in U.S. Pat. No. 4,963,939 issued to Kurando et al, assigned to Mita Industrial Company of Japan and is also incorporated herein by reference. However, the Kurando et al system described in U.S. Pat. No. 4,963,939 employs a magnetic detection circuit in order to detect the permeability of the toner material within the print cartridge in order to identify the type of cartridge loaded therein. This magnetic detection circuit in Kurando et al utilizes sensors located on the outside of the print cartridge and employs magnetic coupling between these sensors located on the outside of the cartridge and the toner within the cartridge in order to generate the permeability-dependent output signals. This detection scheme not only requires relatively sensitive magnetic tuning circuitry and complex and costly output circuitry for driving output sensors, but in addition, and as a result of the use of the above magnetic detection circuit, the above Kurando et al system is not easily retrofittable into existing pinters. This magnetic coupling scheme would therefore require extensive modification to existing printer hardware in order to accomplish a retrofitting operation on existing printers.

SUMMARY OF THE INVENTION

Accordingly, the general purpose and principal object of the present invention is to provide a new and improved and alternative approach to identifying both the presence and type of toner print cartridge which has been loaded into an electrophotographic or laser printer. This novel approach utilizes a reliable DC connectable system which is easy to install.

Another object of this invention is to provide a new and improved DC connectable system of the type described which is elegantly simple and straightforward in both construction and operation.

A further object of this invention is to provide a new and improved DC connectable system of the type described which is easily retrofittable into existing printers and is of low cost construction. This low cost construction is a most important consideration in maximizing profit margins in the highly competitive field of electrophotographic or laser jet printing.

To accomplish the above purpose and objects, we have developed and reduced to practice a toner print cartridge identification system which includes a conductive strip mounted on an outer surface of a toner print cartridge and is indicative of both the presence and type of toner print cartridge loaded within an electrophotographic printer. A pair of electrical contacts are mounted on an inner surface area of the printer housing and are mated with the outer surface area of the conductive strip when the printer is in condition for operation. The pair of electrical contacts, in turn, are connected to a custom personality cartridge located external to the printer and are operative to receive either a zero or a 5 volt signal depending, respectively, on the absence or presence of the conductive strip on the toner print cartridge.

If the conductive strip is present on the print cartridge to thereby indicate that the desired type of toner is present therein, then the zero (0) volt signal is processed through the pair of electrical contacts and to the custom personality cartridge. The custom personality cartridge is then operative to generate an appropriate control signal to a formatter located inside the printer and instructing the printer to print, while simultaneously indicating to the user a "go" condition for the printer. On the other hand, in the absence of the conductive strip on the toner print cartridge, a five (5) volt signal level is present across the pair of electrical contacts to inform the custom personality cartridge that the wrong type of toner is present in the print cartridge. Then the custom personality cartridge instructs the formatter within the printer not to print.

Therefore, briefly summarized commensurate in scope with the broad claims filed herein, the present invention includes, in combination: a) a toner print cartridge operatively received within an electrophotographic printer and having a conductive strip mounted on the surface thereof and indicative of the type of toner within the toner print cartridge; b) a pair of mating electrical contacts operatively engaging the conductive strip on the toner print cartridge when the print cartridge is in condition for a printing operation within the electrophotographic printer; and c) printer control means connected between the pair of contacts and a formatter within the printer for controlling the operation of the printer in response to a signal voltage received from the pair of electrical contacts.

In a preferred embodiment of the invention, the print control means includes a custom personality cartridge connected to receive a control signal from the pair electrical contacts, and an extended board connection used to interconnect the output of the custom personality cartridge to the input of the printer formatter to instruct the formatter either to print or not to print, depending upon the level of signal voltage received from the pair of electrical contacts.

Also in a preferred embodiment of the invention, the extended board connection has an electronic (digital) two-position or equivalent switch therein having one of its two positions connected to ground or reference potential and its other position connected to a toner cartridge sense line. This two-position switch is further connected to and controlled by one output address bus from the personality cartridge. In the no-sense mode, no signal is received on this address line, and the digital two-position switch remains connected to ground or reference potential. In the cartridge sense mode, a signal on this address line electrically switches the digital two-position switch to its other position, thereby connecting the toner cartridge sense line through the extended board connection and into the formatter of the printer to indicate to the formatter and user the type of print cartridge which has been loaded into the printer.

In accordance with the broad method claims filed herein, the novel combination of method steps includes: a) passing current through a conductive strip located on the outside surface of a toner print cartridge to indicate the type of toner loaded therein; b) detecting one of two possible levels of signal voltage developed across the conductive strip to thereby generate either "go" or "no go" control signals; and c) processing the go or no go signals back into the printer for controlling the on/off operation thereof.

The above brief summary of the invention, together with its various objects, novel features and many advantages, will become more readily apparent from the following description of the accompanying drawings.

BRIEF DESCRIPTION OF THE DRAWINGS

FIGS. 1A, 1B, and 1C are isometric views showing how the conductive strip or label on the outside surface of the toner print cartridge will, during printer operation, mate with a pair of electrical contacts located on a predefined inner surface area of the printer housing.

DETAILED DESCRIPTION OF THE PREFERRED EMBODIMENT

Figure 2:
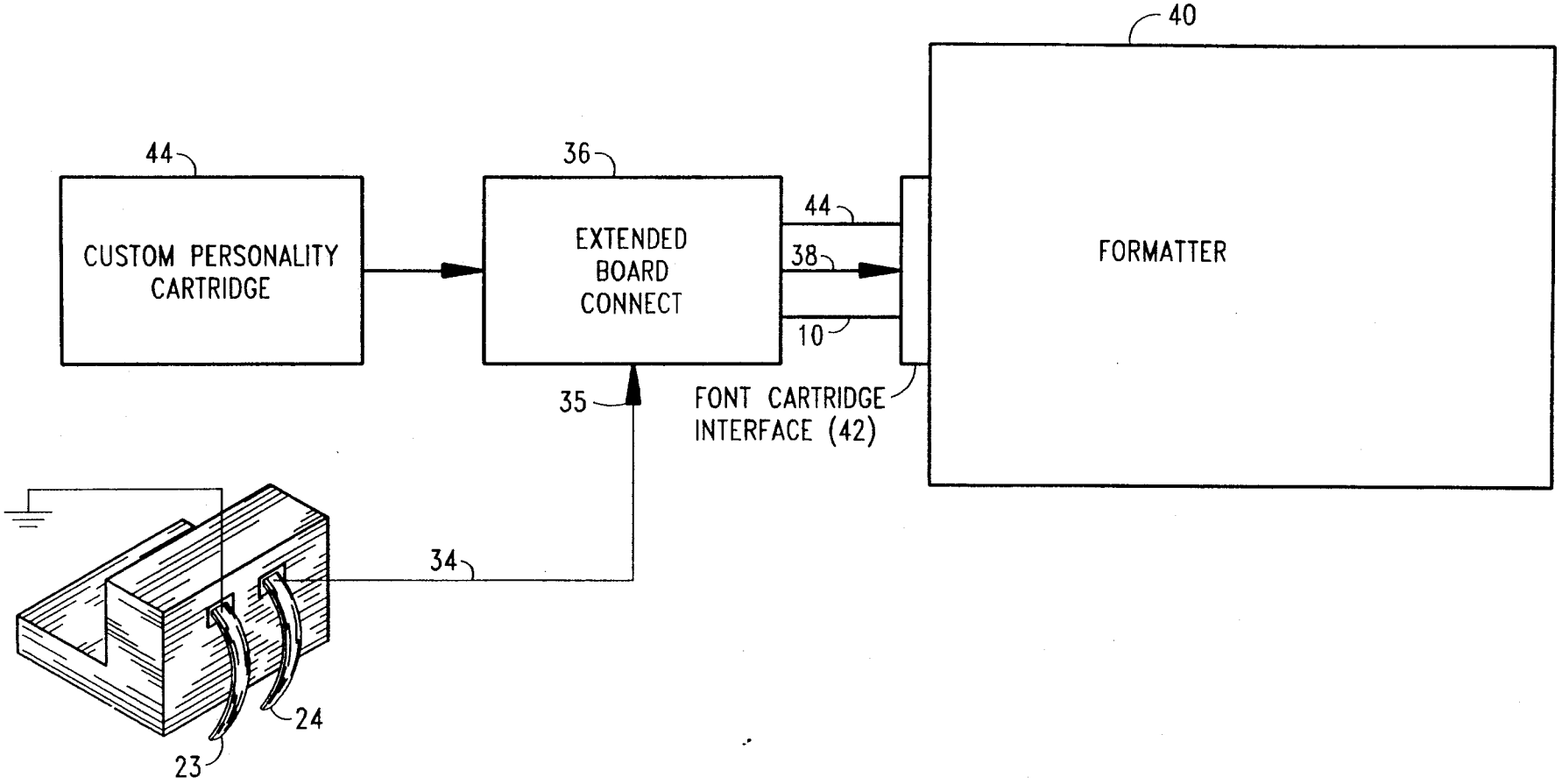
FIG. 2 is a functional system block diagram showing the electrical interconnection of the pair of electrical contacts in FIG. 1 to extended board connection circuitry which serves to interconnect a custom personality cartridge into a formatter inside an electrophotographic printer.

Referring now to FIGS. 1A, 1B, and 1C, there is shown an electrophotographic or laser printer having an outer housing 10 and a laser scanner mechanism 12 which is located adjacent the front or paper loading wall of the printer. The laser scanner 12 includes a window 14 within an interior wall 16 defining one end of a receptacle or cavity 18. This receptacle 18 is configured to receive the lid 20 of the printer which contains therein the removable toner cartridge member 22. The laser scanner 12 whose window 14 faces the toner cartridge 22 is shown in a reversed orientation in the perspective view of FIG. 1B. Also, the L-shaped contact support member 25 for the two contacts 23 and 24 is shown in the enlarged view in FIG. 1C.

The pair of electrical contacts 23 and 24 and supporting member 25 are mounted as shown on a right hand section 26 of the inside wall 16 of the printer as shown in the perspective view in FIG. 1B. Thus, in operation the toner print cartridge 22 in FIG. 1A is loaded into the toner cartridge-receiving lid and housing member 20, and the lid or housing member 20 of the printer 10 is rotated in the direction of the arrow 32. Here, the conductive label 30 will mate and make electrical contact with the pair of electrical contacts 23 and 24 shown in FIGS. 1B and 1C. This action will in turn connect a cartridge-type sense line to a source of DC voltage as described in more detail below.

For example, if the desired type of print cartridge 22, such as a MICR print cartridge having the required magnetic toners therein, has been loaded into the cartridge housing 20, the conductive strip 30 will be present on the cartridge housing outer front surface 28 of the replaceable print cartridge 22. Then, when the lid 20 is closed, this conductive strip or label 30 will establish a DC conductive path across the pair of electrical contacts 23 and generate typically a zero (0) volt DC signal. This signal is then processed as an indication that the printer is now in condition to print with the properly chosen MICR print cartridge.

Referring now to FIG. 2, this zero (0) volt DC signal is generated on line 34 as the required input bias level voltage to one input terminal 35 within an extended board connection stage 36. This extended board connect stage 36 in turn generates a "go" input signal via line 38 as an input control signal to the printer formatter 40 and through a font interface cartridge 42. However, as described in more detail below with reference to FIG. 3, this "go" input signal on line 38 is generated only when the extended board connect 36 is properly accessed by the custom personality cartridge 44. The font interface cartridge 42 is illustrative of merely one of a larger plurality of font cartridge interfaces which may be interconnected to the formatter 40 located, for example, inside Hewlett Packard's LaserJet TM III electrophotographic printer.

Thus, the "go" or "no go" signal generated on line 38 from the extended board connect stage 36 into the font cartridge interface 42 will instruct the printer to print only with the presence of the conductive label or strip 30 on the outer surface 28 of the toner print cartridge 22. Simultaneously, the custom personality cartridge 44 is operative to visually instruct the user that the proper magnetic toner cartridge 22 has been loaded into the printer 10 and that the printer 10 is now ready for printing.

Figure 3:
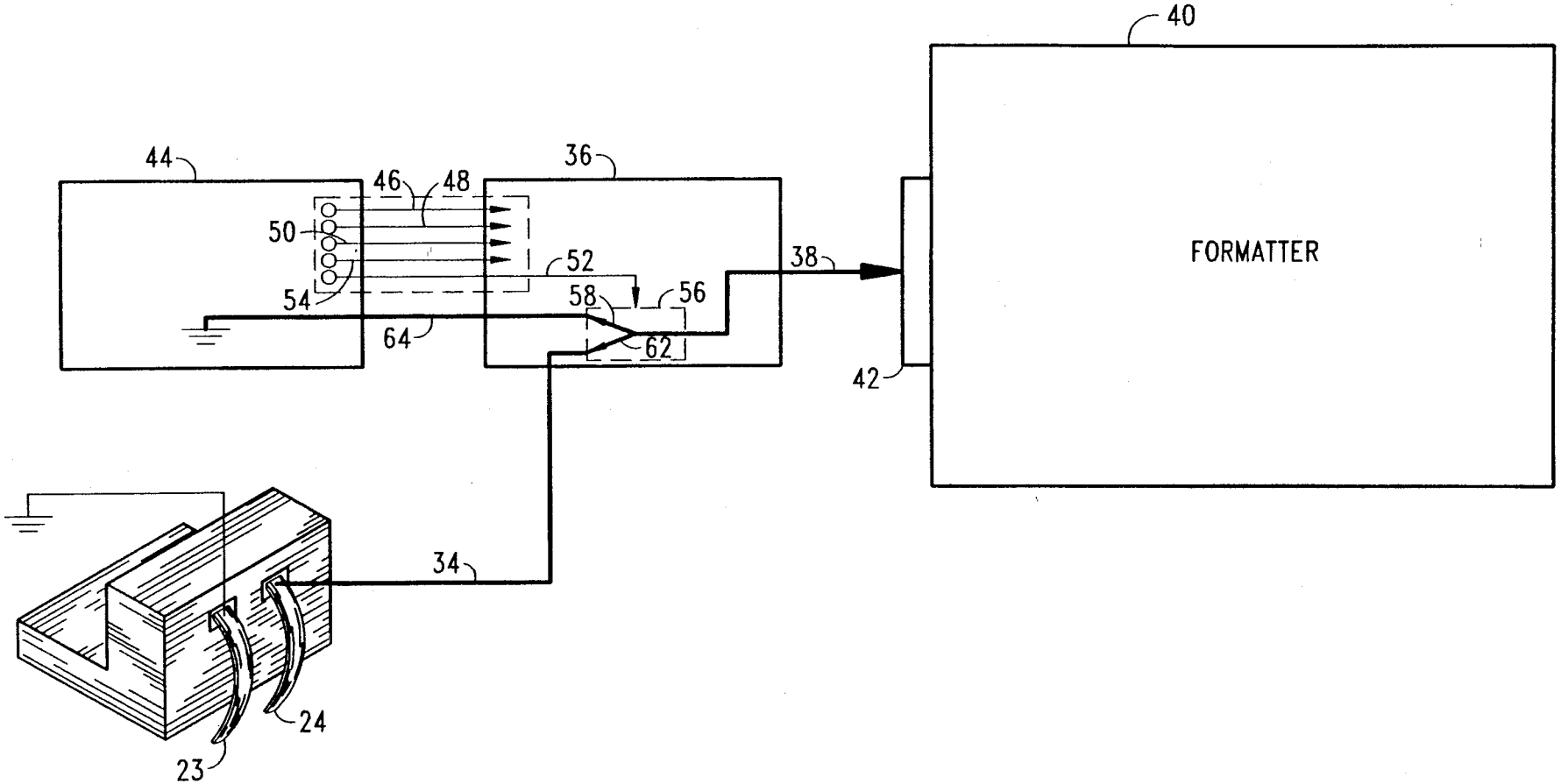
FIG. 3 is a functional system block diagram showing how the address lines with the correct combination of voltage levels selectively control the toner cartridge sense operation.

Referring now to FIG. 3, there is shown a functional block diagram of a preferred embodiment and system implementation of the invention wherein a conventional personality cartridge 44 and extended board connect stage 36 have been modified in a novel manner and with a minimal additional cost for these components so as to process the DC signal on the output line 34. This novel system and circuit implementation enables the type of print cartridge loaded into the printer to be rapidly ascertained by the user.

The custom personality cartridge 44 will typically have a plurality of address lines 46, 48, 50, 52, and 54 leading into the extended board connect stage 36. The proper combination of signals on of all of these address lines will control an electronic two-position switch 56 whose output line 38 is connected as one input to the formatter 40 via font cartridge 42. In one position 58 of the switch 56, the switch 56 is connected via line 64 to ground or reference potential. In the other position 62 of the switch 56, it is connected to line 34 leading from the toner cartridge sense terminals 23 and 24. The block diagram representation at block 56 of the two-position switch having the upper and lower positions 58 and 62 for connection, respectively, to the two lines 64 and 34 is merely a functional representation for many types of integrated digital logic circuits which would customarily be used to perform this function. Or, alternatively, discrete transistor circuits whose two-position switch design is also obviously within the skill of the art can be used to define this digital electronic solid state switch.

When a proper address signal is applied from the personality cartridge 44 and via line 54 to the two-position switch 56, the switch electronically selects the position shown at 62 to thereby connect the signal on line 34 via line 38 to the formatter 40 to thereby indicate to the formatter 40 that either a 5 volt or 0 volt signal is present on line 34. This switching action also indicates to the user the presence or absence of the properly chosen print cartridge which has been loaded into the printer. If the formatter 40 receives the zero (0) volt signal, then the user is informed that the properly chosen print cartridge has been loaded into the printer. If five (5) volts is applied via line 38 to the formatter 40, the user is informed that an improper type print cartridge has been loaded into the printer.

Thus, it is seen that by making only very minor and inexpensive modifications to existing extended board and personality cartridge connections, the level of signal on line 34 can be easily and rapidly processed and monitored by inputs received from the personality cartridge 44 before the printer is used.

Various modifications may be made in and to the above described embodiment without departing from the spirit and scope of this invention. For example, the pair of electrical contacts 23 and 24 are not limited to the particular shape as shown in FIG. 1A and may take various other shapes and sizes. In addition, the present invention may be used with many different types of laser or electrophotograhic printers of the type operative to provide the above cartridge type identification function. Accordingly, such modifications and other obvious circuit and constructional design changes are within the scope of the following appended claims.

We claim:

1. A system for indicating a type of toner print cartridge loaded into an electrophotographic printer including, in combination:

a. a toner print cartridge operatively received within an electrophotographic printer and having a conductive strip thereon representative of the type of toner print cartridge loaded into said printer, b. a pair of mating electrical contacts operatively engaging said conductive strip when said toner print cartridge is in condition for a print operation within said electrophotographic printer, and c. printer control means connected between said pair of mating electrical contacts and a formatter within said printer for controlling an operation of said printer in response to a signal voltage received from said pair of electrical contacts.

2. The system defined in claim 1 wherein said printer control means includes a switching stage connected to said pair of electrical contacts and to said formatter within said printer for controlling a go/no-go operation of said printer, as well as indicating to a user a proper type of toner print cartridge has been loaded into said printer.

3. The system defined in claim 2 wherein said switching stage interconnects an output of a custom personality cartridge to said formatter.

4. The system defined in claim 3 which further includes a switch such as an electronic digital switch connected to an extended board connect stage and further connected at one position or state to a toner cartridge sense line, whereby said switch may be readily accessed by address signals from said personality cartridge to switch said toner cartridge sense line into electrical connection with said formatter to indicate to the user and to the printer the type of print cartridge which has been loaded into said printer.

5. A method for determining a type of print cartridge which has been loaded into a printer, including the steps of:

a. passing current through a conductive strip located on an outside of said cartridge to indicate a type of toner utilized therein, b. utilizing said current to develop one of two possible voltage levels, and c. processing said two possible voltage levels to thereby generate go or no go control signals back into said printer to control a print or no-print operation thereof.

6. The method defined in claim 5 which further includes selectively switching a DC voltage on a toner sense cartridge line into and out of electrical connection with a printer formatter by addressing a switch such as an electronic digital switch within an extended board connect stage.

7. A system for indicating a type of toner print cartridge loaded into an electrophotographic printer including, in combination:

a. a toner print cartridge operatively received within an electrophotographic printer and having a conductive strip thereon representative of the type of toner print cartridge loaded into said printer, and b. a contact support member having a pair of mating electrical contacts mounted thereon and operatively engaging said conductive strip on said toner print cartridge when said toner print cartridge is in condition for a print operation, whereby said pair of mating electrical contacts operate to close an electrical circuit in the presence of said conductive strip to provide an indication that a particular type of print cartridge has been loaded into said printer.

8. The system defined in claim 7 wherein said conductive strip is mounted on an outer front surface of a replaceable print cartridge, whereby when a lid carrying said replaceable print cartridge is closed, said conductive strip will establish a DC conductive path across said pair of electrical contacts and generate a zero (0) volt DC signal which may be processed as an indication that the printer is now in condition to print with a properly chosen magnetic ink character recognition print cartridge.

9. The system defined in claim 8 which further includes printer control means having a switching stage connected to said pair of electrical contacts and further connected to a formatter within said printer for controlling a go/no-go operation of said printer, as well as indicating to a user that a proper type of toner print cartridge has been loaded into said printer.

10. The system defined in claim 9 wherein said switching stage interconnects an output of a custom personality cartridge to said formatter.

11. The system defined in claim 10 which further includes a switch such as an electronic digital switch connected to an extended board connect stage and further connected at one position or state to a toner cartridge sense line, whereby said switch may be readily accessed by address signals from said personality cartridge to switch said toner cartridge sense line into electrical connection with said formatter to indicate to the user and to the printer the type of print cartridge which has been loaded into said printer.

* * * * *